United States Patent [19]

Sargent et al.

[11] 4,192,027

[45] Mar. 11, 1980

[54] TOILET

[75] Inventors: Frank T. Sargent, Ann Arbor, Mich.; Frederick A. Butler, Leamington Spa, England

[73] Assignee: Thetford Corporation, Ann Arbor, Mich.

[21] Appl. No.: 926,932

[22] Filed: Jul. 21, 1978

[30] Foreign Application Priority Data

Jul. 25, 1977 [GB] United Kingdom ..... 31164/77

[51] Int. Cl.[2] ..... E03D 11/10

[52] U.S. Cl. ..... 4/441; 4/438

[58] Field of Search ..... 4/441, 442, 113.1, 114.1, 4/144.1, 429, 432, 435, 438, 440

[56] References Cited

U.S. PATENT DOCUMENTS

| | | | |
|---|---|---|---|
| 3,566,418 | 3/1971 | Carlson et al. | 4/441 |
| 3,798,681 | 3/1974 | Johansen | 4/440 |
| 3,883,903 | 5/1975 | Vanden Broek et al. | 4/440 |
| 3,939,501 | 2/1976 | Sargent | 4/115 |
| 4,032,996 | 7/1977 | Sargent et al. | 4/441 |

*Primary Examiner*—Henry K. Artis

*Attorney, Agent, or Firm*—Olsen and Stephenson

[57] ABSTRACT

A portable toilet is provided with a bowl having an outlet port in its bottom, this being closed by a yoke shaped, pivotal valve member movable between a first position in which it closes the outlet port and a second position in which it uncovers the port. An actuation member moves relative to the valve member and cooperating cam surfaces on the valve member and actuation member urge the valve member upwardly to seal the outlet port upon such relative movement.

10 Claims, 5 Drawing Figures

TOILET

The present invention relates to toilets, and in particular to portable toilets.

Various types of portable toilets are known, the simplest form being, essentially, a bucket provided with a seat, this type, although relatively inexpensive, is generally unsatisfactory because it tends to give off an unpleasant odour, even when treated with chemicals. A further form is a flushing toilet provided with filters in the pump in which the water content of the waste matter is cleaned and is recirculated. Such a construction has the disadvantage that it is expensive and the filter tends to clog. A further form has a bowl section and a collecting section, thereunder, the outlet to the bowl section being provided with a valve of the pivotal flap or sliding valve type. The form of this flap valve is generally unsatisfactory, because it tends to dip into the waste matter in the collecting section. The slide valve, on the other hand, is usually satisfactory from a working point of view, but it can be rather cumbersome and expensive.

It has been proposed, in our British patent specification No. 1482201 and corresponding U.S. Pat. No. 3,939,501 to provide a toilet comprising a bowl having an outlet port, a flexible diaphragm, movable between a first position, in which it closes the outlet port, and a second position, in which it uncovers said outlet port, and means to apply tension to the diaphragm to maintain it taut, in contact with the outlet port when it is in said first position.

Such a construction is relatively uncomplicated and not too expensive. However, it would be of advantage to be able to reduce the cost and to ensure a better sealing of the outlet port.

It is now proposed according to the present invention to provide a toilet comprising a bowl having an outlet port, a valve member movable between a first position, in which it closes said outlet port, and a second position, in which it uncovers the outlet port, an actuation member movable relative to said valve member and cooperating cam surfaces on said actuating member and valve member, whereby relative movement between the actuating member and the valve member, when the latter is in its first position, urges the valve member in an upward direction to seal the outlet port.

Such a construction can be made relatively inexpensive and the cam action causes a thorough sealing of the outlet port.

Advantageously the cam surfaces are simply ramps formed on the lower face of the valve member. In order to ensure a better seal effect, the outlet port may be provided with a downwardly extending annular curtain seal.

The operation of the actuating member is desirably first such that it moves the cam surfaces to release the valve member for downward movement and thereafter moves the valve member towards its open position. The valve member can lift off the outlet port or curtain seal (where provided) by the action of gravity. However, in some instances it may be desirable for a spring to be provided, for example between the valve member and the actuating member, to urge the valve member towards its first position.

In one preferred embodiment of the invention, two parallel guide webs extend downwardly from the bowl, one on each side of the outlet ports, and the valve member is provided with upwardly extending guide members which engage the guide webs, to guide the valve member between its first and second positions. The valve member advantageously slides over the lower edges of the guide webs which may be so shaped that the initial movement of the valve member from its second position to its first position lowers the leading edge of the valve member to facilitate movement over the outlet port. The guide webs may be provided with abutments to stop the valve member in its first position, so that further movement of the actuating member causes the camming operation to take place to urge the valve against the outlet.

The actuating member may be in the form of a yoke which is pivoted at its ends to the bowl and have the upper surface portion extending below the valve member.

In order that the invention may more readily be understood, the following description is given, merely by way of example, reference being made to the accompanying drawings, in which.

Figure 1:
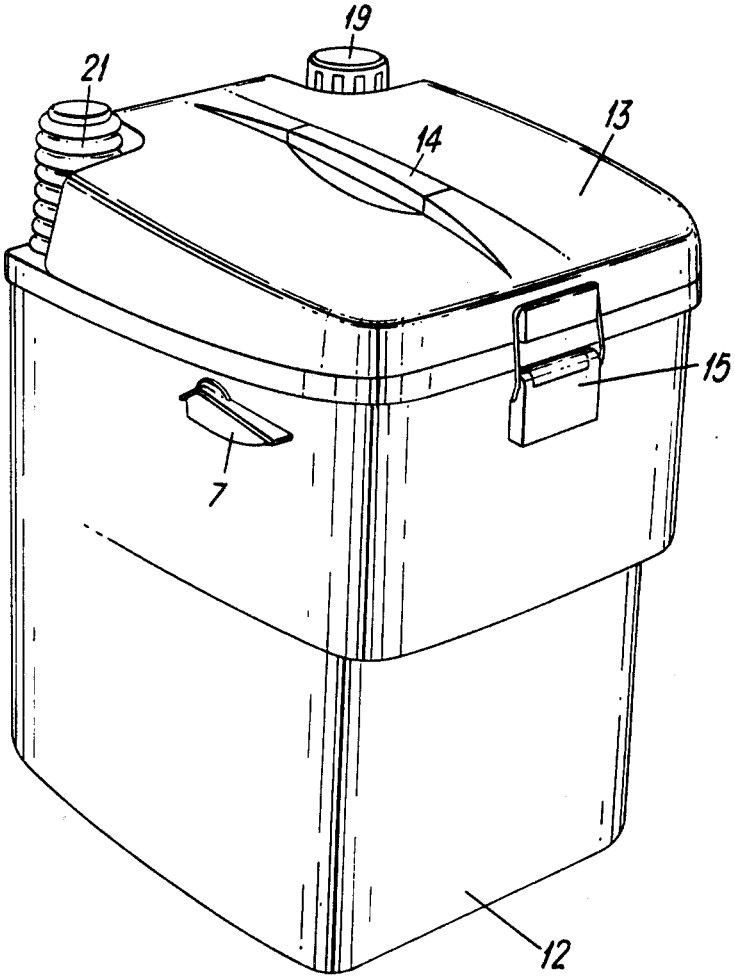
FIG. 1 is a perspective view of one embodiment of toilet according to the invention.

Referring first to FIG. 1, the toilet includes a bucket section 12, which is surmounted by a pivotable seat (not shown) and a lid 13 having a handle 14 with a recess thereunder. The handle 14 is normally flush with the top of the lid and is connected by two flexible resilient plastics strips having enlarged heads, so that one can first of all put ones hand under the handle and lift slightly and then further movement causes the whole toilet to be lifted, since the lid 13 is pivoted at its rear and can be secured in place by a clamp 15 at the front.

At the upper part of the front, the bucket houses a flushing water tank 16 provided with a filling pipe, not shown, which finishes at the rear of the toilet and one side thereof, a vertical filling tube, not shown having therein a buoyant ball e.g. a ping-pong ball and surmounted with a fitting cap 19. The filling tube and filling pipe are essentially the same as the corresponding parts shown and described in British Pat. No. 1482201.

Figure 2:
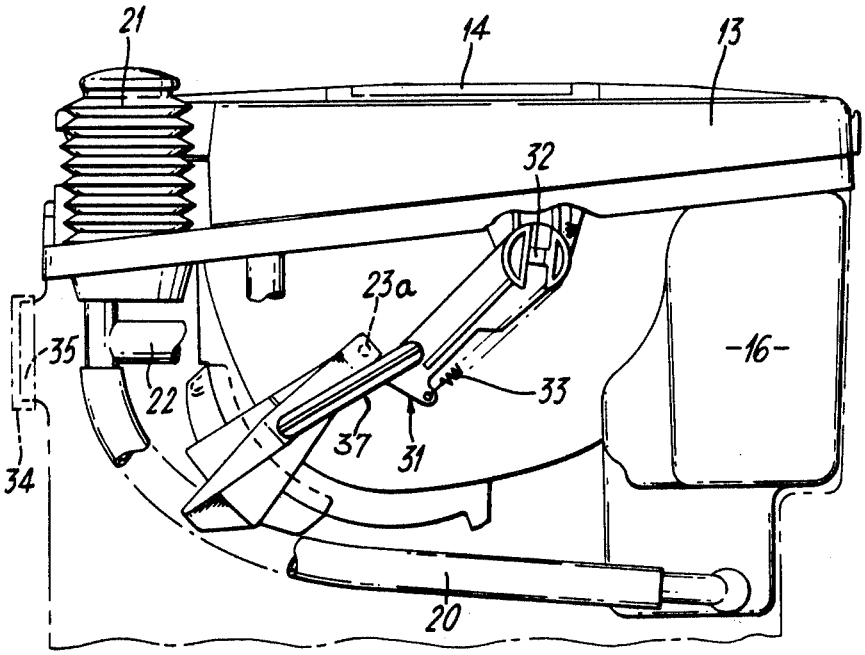
FIG. 2 is a partial side elevation of one side of the toilet of FIG. 1, the bucket portion shown in phantom to reveal the interior and the operating mechanism.

As can be seen from FIG. 2 from the foot of the tank 16, extends a pipe 20 which is connected to the inlet of a bellows pump 21, the outlet of which is joined to a tube which extends to a portion adjacent the rim of the bowl and is provided with an outlet to cause water to flow in a spiral motion around the bowl.

Figure 3:
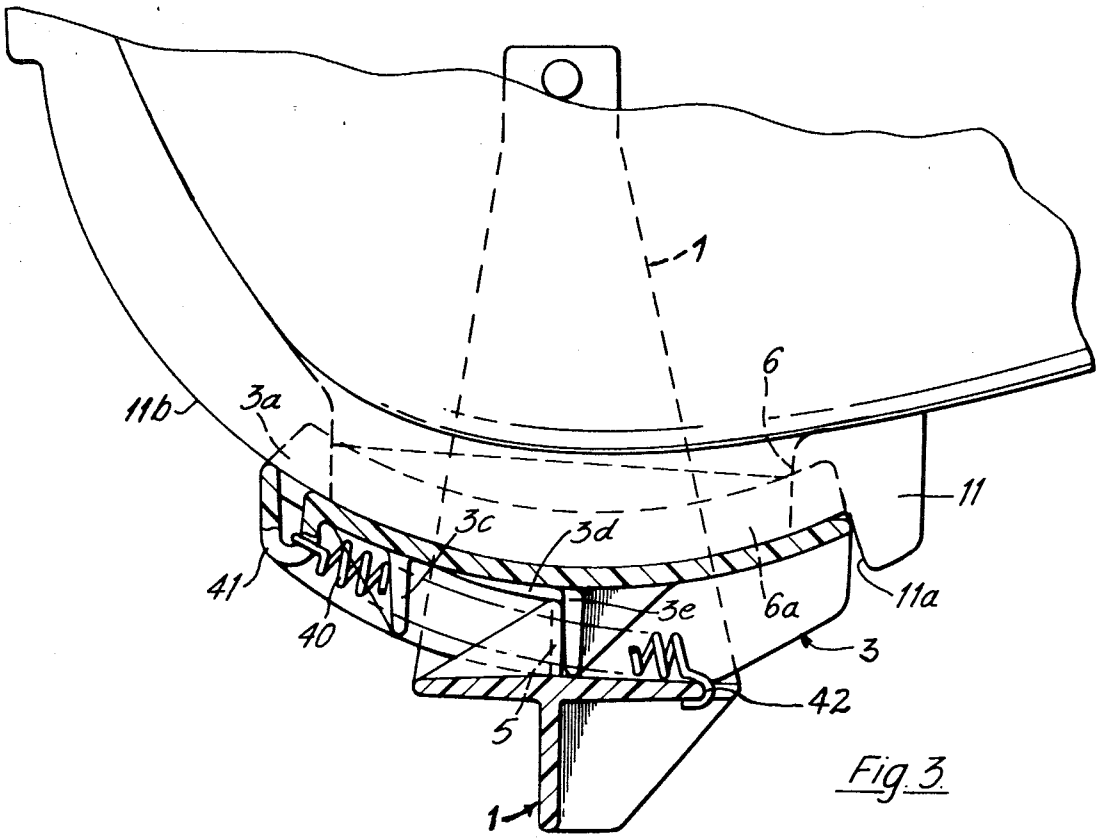
FIG. 3 is an enlarged view showing the valve member in its closed position.
Figure 5:
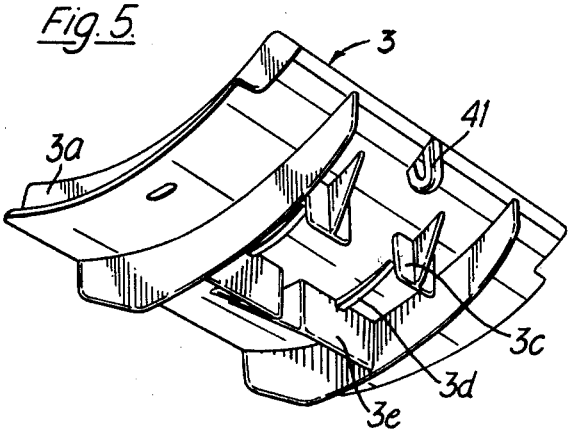
FIG. 5 is a perspective view of the valve member.

The construction so far described is very similar to that of British Pat. No. 1482201. The operating mechanism for closing the valve is quite different. As can be seen in particular from FIG. 3, the bowl has a downwardly extending outlet port 6, provided with an annular curtain seal **6*a*. Extending on either side are two guide webs 11 each having, adjacent one end, an abutment 11*a*. The lower edges 11*b* of the webs act as guides for a valve member or plate 3 of generally arcuate form and having upwardly extending guide portions 3*a* (see FIGS. 3 and 5) slidably engageable within the guide webs 11. The valve in FIG. 3 is shown in its closed position with the leading edge of the valve member 3** engaging the abutment 11*a*. As can be seen in the drawings, the lower surface of the valve member is provided with two spaced apart abutment members 3*c* and 3*e*, the forward member 3*e* of these two having associated therewith a cam surface 3*d* sloping downwardly towards the front end. In fact the members 3*c* and 3*e* are preferably each provided in two parts and each have back-up support webs of triangular shape.

Figure 4:
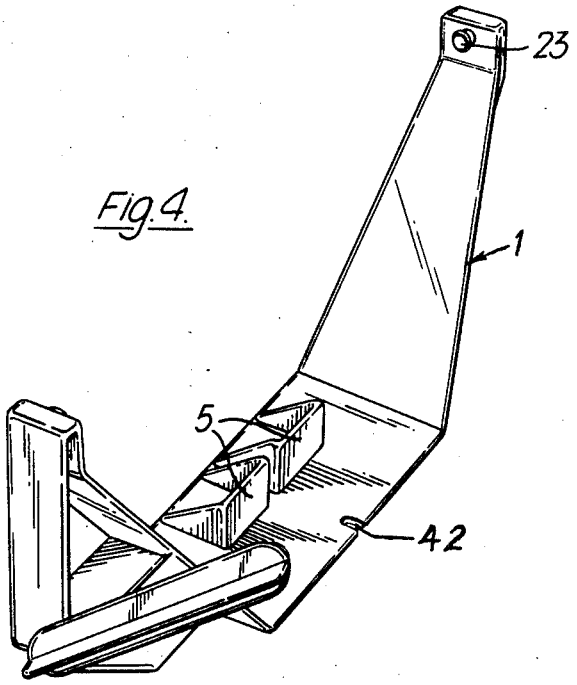
FIG. 4 is a perspective view of the actuation member.

An actuation member 1 (see particularly FIG. 4) is in the form of a yoke in which the valve member 3 is carried and having two end portions provided with inwardly directed pins 23 which engage in sockets 23*a* in the bowl (see FIG. 2). The central portion of the yoke has, on its upper surface, a projecting element 5 which is shown in FIG. 3 engaged against the forward member 3*e* and also with its upper surface against the cam 3*d*. Again this member 5 can be in two parts with rearwardly extending support webs of triangular form.

As can be seen in particular in FIG. 2 and FIG. 1, an operating handle 7 is provided on the outside of the bucket portion and this handle has associated therewith an arm 31 which is pivoted to the bowl at 32 and is provided with a drive connection with the actuation member 1. A return spring 33 is provided for the arm 31 for a purpose to be explained later.

In actual use, when opening the valve, the operating handle 7 is moved downwardly which moves the connecting arm 31, and a rod 37, which in turn moves the actuation member 1 to the left as viewed in FIGS. 2 and 3 so that the actuation member 1 takes up the position illustrated in FIG. 2, and the projecting element 5 engages the rearward member 3*c* to move the valve member 3 to the left. In the initial part of this movement, the projecting element 5 slides along the cam 3*d* thus releasing the forward end of the valve member 3 so that it can drop slightly downwardly to disengage it from the curtain seal 6*a*. Having engaged the member 3*c*, the actuation member 1 continues to move backwardly taking the valve member with it so that the latter then takes up the position illustrated in FIG. 2. This position of the assembly provides a full opening of the bowl outlet port 6, this given an unimpeded full flow emptying of the toilet bowl by gravity.

This fully open position of the valve member 3 also provides emptying and drainage of the valve member itself. In this way, it drains away completely. In fact from the half way open position to the fully open position the valve member is in a position in which it drains into the bucket.

The closing operation is performed by rotating the operating handle 7 in the opposite direction to that previously described. The effect of gravity is to allow the valve member to drop forwards towards its closed position until it engages the stop 11*a*. If desired, this effect can be increased by the action of a further spring 40 extending between a downwardly extending loop portion 41 of the valve member 3 and the forward edge 42 of the actuation member 1. Once the valve member 3 has engaged the stop 11*a*, continued movement of the actuation member 1 under the action of the return spring 33 ensures that the valve member 3 is urged firmly against the curtain seal 6*a*.

It will be appreciated that the construction just described is extremely simple and that the valve member 3 and the actuation member 1 can each be formed as a simple injection moulding. All these parts can be formed in a white plastics material and it is unnecessary to use expensive stainless steel parts as in the structure of the British Pat. No. 1482201.

We claim:

1. A toilet comprising, in combination:

(a) a bowl having an outlet port;

(b) a valve member movable between a first position under said outlet port, in which it closes said outlet port, and a second position in which it uncovers the outlet port;

(c) an actuation member carrying said valve member and movable relative to said valve member and (d) cooperating cam surfaces on said actuation member and valve member whereby relative movement between the actuation member and the valve member, when the latter is moved into its first position by the former, urges the valve member in an upward direction to seal the outlet port.

2. A toilet as claimed in claim 1, wherein at least one of said cam surfaces is provided on the lower face of the valve member.

3. A toilet as claimed in claim 1, and further comprising a downwardly extending annular curtain seal on said outlet port.

4. A toilet as claimed in claim 1, wherein operation of the actuation member firstly moves the cam surfaces to release the valve member towards its open position.

5. A toilet as claimed in claim 1, and further comprising spring means effective to urge the valve member towards its first position.

6. A toilet as claimed in claim 1, and further comprising two parallel guide webs extending downwardly from the bowl, one on each side of the outlet port, and upwardly extending guide portions on said valve member engage the guide web to guide the valve member between its first and second positions.

7. A toilet as claimed in claim 6, wherein the valve member slides over the lower edges of the guide webs.

8. A toilet as claimed in claim 7, wherein the lower edges are so shaped that the initial movement of the valve member from its second position to its first position lowers the leading edge of the valve member to facilitate movement over the outlet port.

9. A toilet as claimed in claim 7, and further comprising abutments on said guide webs to stop the valve member in the first and second positions.

10. A toilet as claimed in claim 1, wherein said actuation member comprises a yoke pivoted at its end to the bowl and having the upper surface of its central portion extending below the valve member, and an upwardly projecting element sliding along at least one cam on the lower surface of the valve member.

* * * * *